US009682309B2

(12) United States Patent
Huang

(10) Patent No.: US 9,682,309 B2
(45) Date of Patent: Jun. 20, 2017

(54) POWERED WHEELED BOARD

(71) Applicant: Joey Chih-Wei Huang, Temple City, CA (US)

(72) Inventor: Joey Chih-Wei Huang, Temple City, CA (US)

(73) Assignee: RAZOR USA LLC, Cerritos, CA (US)

( * ) Notice: Subject to any disclaimer, the term of this patent is extended or adjusted under 35 U.S.C. 154(b) by 0 days.

(21) Appl. No.: 14/951,371

(22) Filed: Nov. 24, 2015

(65) Prior Publication Data

US 2016/0144267 A1 May 26, 2016

Related U.S. Application Data

(60) Provisional application No. 62/085,163, filed on Nov. 26, 2014, provisional application No. 62/137,449, filed on Mar. 24, 2015.

(51) Int. Cl.

| | |
|---|---|
| ***A63C 17/12*** | (2006.01) |
| ***A63C 17/00*** | (2006.01) |
| ***A63C 17/04*** | (2006.01) |
| ***A63C 17/01*** | (2006.01) |

(52) U.S. Cl.

CPC ..... *A63C 17/12* (2013.01); *A63C 17/0033* (2013.01); *A63C 17/016* (2013.01); *A63C 17/04* (2013.01); *A63C 17/014* (2013.01); *A63C 2203/22* (2013.01); *A63C 2203/40* (2013.01)

(58) Field of Classification Search

CPC ..... A63C 17/12; A63C 17/04; A63C 17/06; A63C 17/016; A63C 17/014; A63C 17/0033; A63C 2203/22; A63C 2203/40

USPC ..... 180/180, 181, 218, 219, 220; 280/87.01, 280/87.041, 87.042, 87.043

See application file for complete search history.

(56) References Cited

U.S. PATENT DOCUMENTS

| | | | |
|---|---|---|---|
| 2,051,762 | A | 8/1936 | Vincent |
| 3,399,906 | A | 9/1968 | Portnoff |
| 3,982,766 | A | 9/1976 | Budge |
| 4,060,253 | A | 11/1977 | Oldendorf |
| 4,076,267 | A | 2/1978 | Lipscomb |

(Continued)

FOREIGN PATENT DOCUMENTS

| | | |
|---|---|---|
| GB | 2318519 | 4/1998 |
| GB | 2464676 | 4/2010 |

(Continued)

OTHER PUBLICATIONS

Miclle's Electric Wave Board [XinCheJian], URL—http://xinchejian.com/2011/05/07/miclles-electric-wave-board/, May 7, 2011.

(Continued)

*Primary Examiner* — John Walters

(74) *Attorney, Agent, or Firm* — Knobbe, Martens, Olson & Bear, LLP

(57) ABSTRACT

Various powered wheeled board vehicles are disclosed. In some embodiments, the vehicle includes a deck having a forward portion and a rearward portion. At least one front wheel can be connected with the deck under the forward portion. The front wheel can be configured to swivel about a first axis and rotate about a second axis. A powered wheel can be connected with the rearward portion. In some configurations, the rear wheel comprises a hub motor.

25 Claims, 10 Drawing Sheets

(56) References Cited

U.S. PATENT DOCUMENTS

| | | | | |
|---|---|---|---|---|
| 4,082,306 | A | 4/1978 | Sheldon | |
| 4,092,033 | A | 5/1978 | Swain | |
| 4,093,252 | A | 6/1978 | Rue | |
| D250,492 | S | 12/1978 | Kish | |
| 4,140,326 | A | 2/1979 | Huber | |
| 4,245,848 | A | 1/1981 | Dudouyt | |
| 4,295,656 | A | 10/1981 | Moore | |
| 4,411,442 | A | 10/1983 | Rills | |
| 4,915,403 | A | 4/1990 | Wild | |
| 4,921,513 | A | 5/1990 | Parten | |
| 4,930,794 | A | 6/1990 | Chan | |
| 4,955,626 | A | 9/1990 | Smith | |
| 5,098,087 | A | 3/1992 | Matile | |
| 5,160,155 | A | 11/1992 | Barachet | |
| 5,267,743 | A | 12/1993 | Smisek | |
| D345,406 | S | 3/1994 | Shankland | |
| 5,330,026 | A * | 7/1994 | Hsu | A63C 17/01 180/181 |
| 5,419,570 | A | 5/1995 | Bollotte | |
| 5,458,351 | A | 10/1995 | Yu | |
| 5,505,474 | A | 4/1996 | Yeh | |
| 5,540,455 | A | 7/1996 | Chambers | |
| 5,549,331 | A | 8/1996 | Yun | |
| 5,566,956 | A | 10/1996 | Wang | |
| 5,601,299 | A | 2/1997 | Yun | |
| 5,622,759 | A | 4/1997 | Fuster | |
| 5,707,068 | A | 1/1998 | Bradfield | |
| 5,826,895 | A | 10/1998 | Bradfield | |
| 5,853,182 | A | 12/1998 | Finkle | |
| 5,855,385 | A | 1/1999 | Hambsch | |
| 5,893,425 | A * | 4/1999 | Finkle | A63C 17/01 180/180 |
| D413,954 | S | 9/1999 | Gerlach | |
| 5,984,328 | A | 11/1999 | Tipton | |
| 6,059,303 | A | 5/2000 | Bradfield | |
| 6,102,415 | A | 8/2000 | Stewardson | |
| 6,193,249 | B1 | 2/2001 | Buscaglia | |
| 6,254,113 | B1 | 7/2001 | Dornan | |
| 6,494,467 | B1 | 12/2002 | Menges | |
| 6,502,850 | B1 | 1/2003 | Schaller et al. | |
| 6,669,215 | B2 | 12/2003 | Laporte | |
| 6,910,698 | B2 | 6/2005 | Turner et al. | |
| 6,979,006 | B2 | 12/2005 | Pierron | |
| 7,044,486 | B2 | 5/2006 | Wright | |
| 7,083,178 | B2 | 8/2006 | Potter | |
| 7,195,259 | B2 | 3/2007 | Gang | |
| 7,198,280 | B2 * | 4/2007 | Hara | A63C 17/0033 280/29 |
| D564,613 | S | 3/2008 | Hamborg | |
| 7,338,056 | B2 | 3/2008 | Chen et al. | |
| 7,367,572 | B2 | 5/2008 | Jiang | |
| D614,714 | S | 4/2010 | Walworth | |
| 8,414,000 | B2 * | 4/2013 | Chen | A63C 17/0033 280/87.021 |
| D698,881 | S | 2/2014 | Hamborg | |
| D699,803 | S | 2/2014 | Yamabe | |
| D705,372 | S | 5/2014 | Harris | |
| 8,915,506 | B2 | 12/2014 | Piaceski et al. | |
| D728,048 | S | 4/2015 | Stover | |
| D770,585 | S | 11/2016 | Desberg | |
| 2002/0043774 | A1 | 4/2002 | Chou | |
| 2002/0149166 | A1 | 10/2002 | Potter | |
| 2003/0124923 | A1 | 7/2003 | Mercer | |
| 2003/0155733 | A1 | 8/2003 | Tan et al. | |
| 2004/0262872 | A1 | 12/2004 | Kang | |
| 2006/0049595 | A1 * | 3/2006 | Crigler | A63C 17/01 280/87.042 |
| 2006/0055137 | A1 | 3/2006 | Jiang | |
| 2006/0163830 | A1 | 7/2006 | Kwak | |
| 2007/0001414 | A1 | 1/2007 | Kang | |
| 2007/0272465 | A1 * | 11/2007 | Su | A63C 17/014 180/181 |
| 2007/0273118 | A1 * | 11/2007 | Conrad | A63C 17/0033 280/87.042 |
| 2011/0037238 | A1 | 2/2011 | Devine | |
| 2013/0001910 | A1 | 1/2013 | Hsu | |

FOREIGN PATENT DOCUMENTS

| | | |
|---|---|---|
| JP | H01-117385 U | 8/1989 |
| JP | 2001-029663 | 2/2001 |
| KR | 1020050060368 | 6/2005 |
| KR | 200410530 | 3/2006 |
| SU | 1405865 | 4/1986 |
| WO | WO 93/01870 A1 | 2/1993 |
| WO | WO 02/40116 | 5/2002 |
| WO | WO 2004/105901 A1 | 12/2004 |
| WO | WO 2006/022472 | 3/2006 |
| WO | WO 2007/102645 | 9/2007 |
| WO | WO 2007/117092 | 10/2007 |
| WO | WO 2009/036074 | 3/2009 |
| WO | WO 2016/086066 | 6/2016 |

OTHER PUBLICATIONS

"About: Skateboarding; The Wave" http://skateboard.about.com/cs/fringeboarding/gr/XBoard.htm, apparently available Jan. 2007.

PCT Search Report and Written Opinion for International Application No. PCT/US2015/062534 mailing date Feb. 15, 2016.

"The Wave", Streetsurfing, http://www.streetsurfing.com/wave/skating.html, apparently available Mar. 2007.

"About: Skateboarding; Other Boardsports", http://skateboard.about.corn/cs/fringeboarding/gr/?once-tru&;, apparently available Mar. 2007.

* cited by examiner

POWERED WHEELED BOARD

CROSS REFERENCE

This application claims the priority benefit under 35 U.S.C. §119 of U.S. Patent Application No. 62/085,163, filed Nov. 26, 2014, and U.S. Patent Application No. 62/137,449, filed Mar. 24, 2015, the entirety of each of which are hereby incorporated by reference. Additionally, any applications for which a foreign or domestic priority claim is identified in the Application Data Sheet as filed with the present application are hereby incorporated by reference in their entirety.

BACKGROUND

Field

The present disclosure relates to personal mobility vehicles, such as skateboards. In particular, the present disclosure relates to personal mobility vehicles with a rear powered wheel and/or other features.

Description of Certain Related Art

Many types of personal mobility vehicles exist, such as skateboards, scooters, bicycles, karts, etc. A user can ride such a vehicle to travel from place to place.

SUMMARY

However, a need still exists for new and/or improved designs, which may provide a new riding experience or unique functionality. The systems, methods and devices described herein have innovative aspects, no single one of which is indispensable or solely responsible for their desirable attributes. Without limiting the scope of the claims, certain features of some embodiments will now be summarized.

In some configurations, a powered board vehicle is disclosed. The powered board vehicle includes a flexible deck having a forward portion and a rearward portion; at least one front wheel connected with the deck under the forward portion, the front wheel configured to swivel about a first axis and rotate about a second axis; and a powered rear wheel connected with the deck and in a fixed alignment relative to the deck; wherein the deck permits rotation of the front portion relative to the rear portion to permit a user to twist the forward portion relative to the rearward portion in alternating directions about a longitudinal axis of the deck. In some configurations, the rear wheel comprises a hub motor. In some configurations, the front wheel and the rear wheel are aligned with a longitudinal axis of the vehicle. In some configurations, a diameter of the front wheel is different from a diameter of the rear wheel. In some configurations, a diameter of the front wheel is equal to a diameter of the rear wheel.

In some configurations, the vehicle further includes two front, swivelable wheels connected with the deck under the forward portion, the two front wheels aligned such that an axis passing through the center of each of the front wheels is orthogonal to a longitudinal axis of the vehicle when the two front wheels are aligned parallel to the longitudinal axis of the vehicle. In some configurations, the two front wheels are supported by a mounting bracket that is supported by the deck, wherein the mounting bracket is configured to move relative to the deck. In some configurations, the mounting bracket can pivot or rock relative to the deck.

In some configurations, the vehicle further includes a rotational coupling or other torsional-flex-facilitating structure between the forward portion and the rearward portion of the deck. In some configurations, the rotational coupling includes one or more pivot assemblies and/or a biasing element to bias the forward portion and the rearward portion into a neutral or aligned relative position.

In some configurations, the deck further comprises a molded plastic platform to provide a gripping surface on a top surface of the deck. In some configurations, the deck further comprises a thin portion in a lateral direction between the forward portion and the rearward portion to allow the deck to twist or flex. In some configurations, a lateral axis bisects the deck at a midpoint of the deck, the lateral axis orthogonal to the longitudinal axis of the deck, the forward portion of the deck narrows to a point forward of the lateral axis and the thin portion is rearward of the lateral axis. In some configurations, the deck is relatively consistent in lateral width throughout at least a midpoint of its length and a source of power is supported by the deck.

In some configurations, the vehicle further includes a wired or wireless remote control that controls the powered rear wheel.

In another configuration, a powered personal mobility vehicle includes a body having a deck, the deck being configured to support a user, the deck having a forward portion and a rearward portion; a caster assembly connected with the deck; at least one front wheel connected with the caster assembly and rotatable about a first axis; a rear wheel connected with the body and rotatable about a second axis; and a motor connected with the body and arranged to transfer rotational force to the rear wheel wherein the forward and the rearward portions are spaced apart by a neck portion that is laterally narrower than both the forward portion and the rearward portion, thereby allowing the deck to twist or flex about a longitudinal axis of the vehicle that passes through the neck.

In some configurations, the forward portion of the deck narrows to a pointed tip.

In some configurations, the vehicle includes two front caster wheels connected to a mounting bracket connected to the body such that an axis passing through a center of each of the front wheels is orthogonal to a longitudinal axis of the body when the front caster wheels are oriented parallel to the longitudinal axis of the body. In some configurations, the mounting bracket is configured to move relative to the deck. In some configurations, the front wheel and the rear wheel are aligned with a longitudinal axis of the vehicle.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION OF CERTAIN EMBODIMENTS

Figure 1:
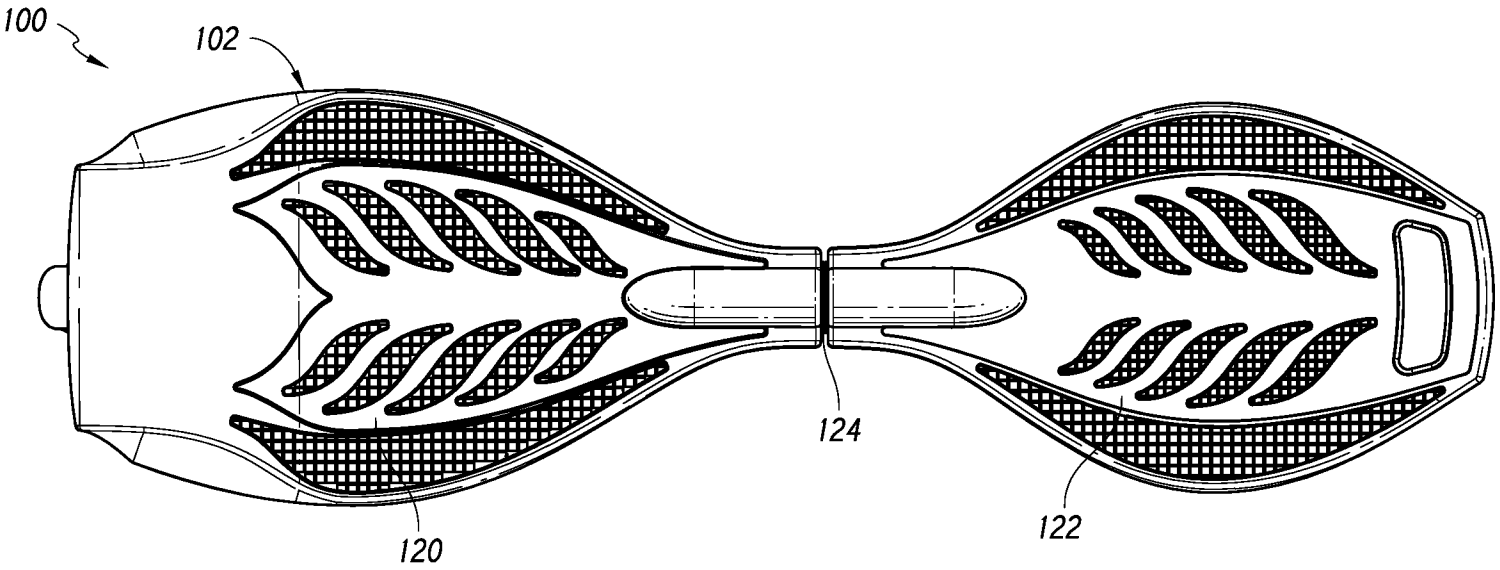
FIG. 1 is a top view of a skateboard according to an embodiment.
Figure 2:
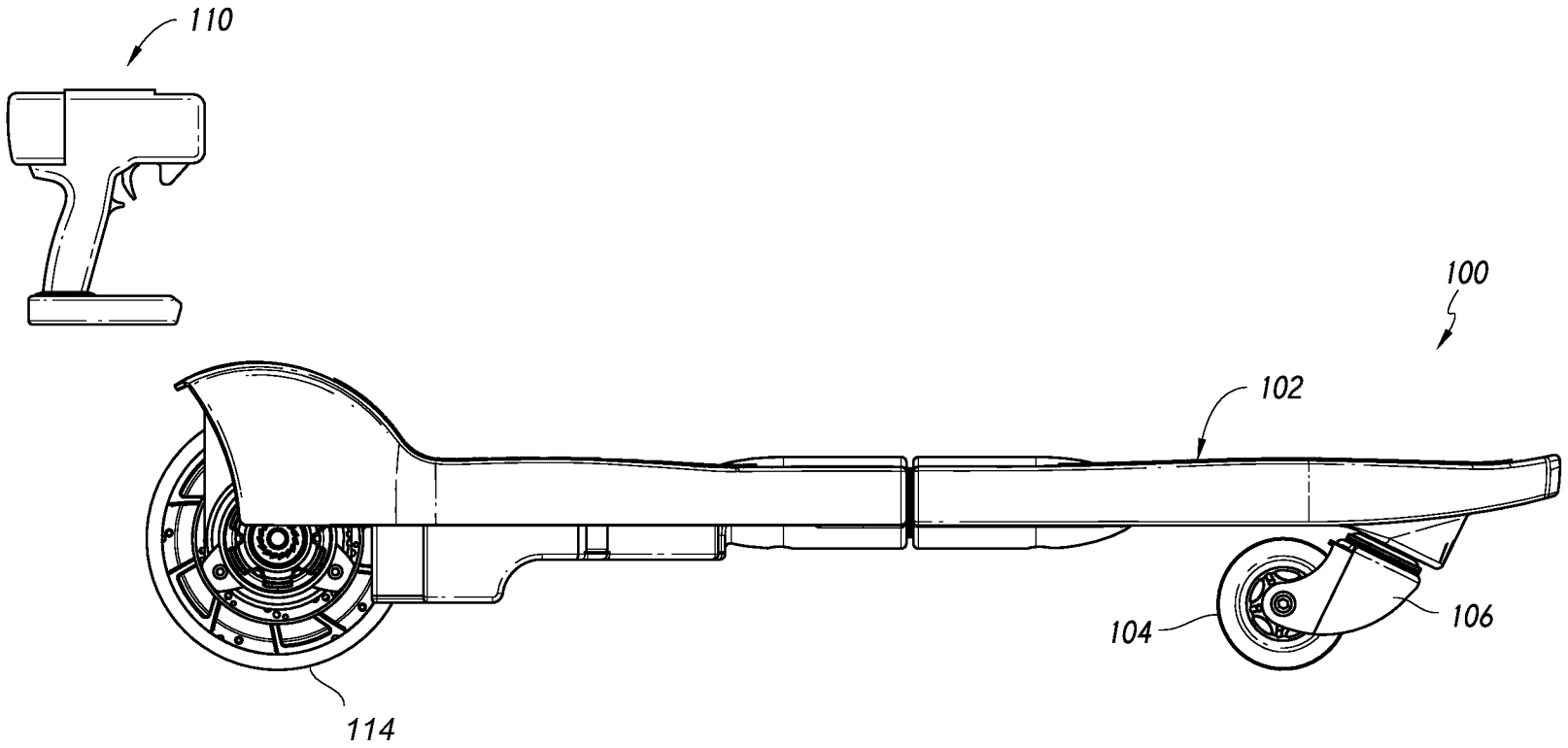
FIG. 2 is a side view of the skateboard of FIG. 1 and a control unit.
Figure 3:
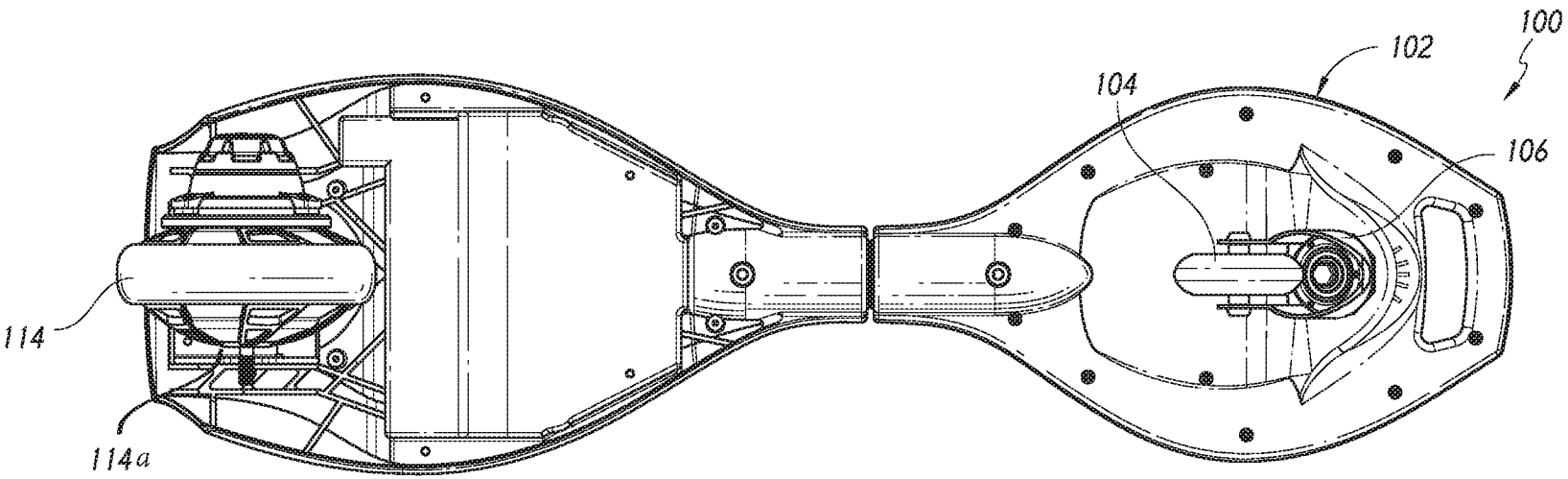
FIG. 3 is a bottom view of the skateboard of FIG. 1.
Figure 4:
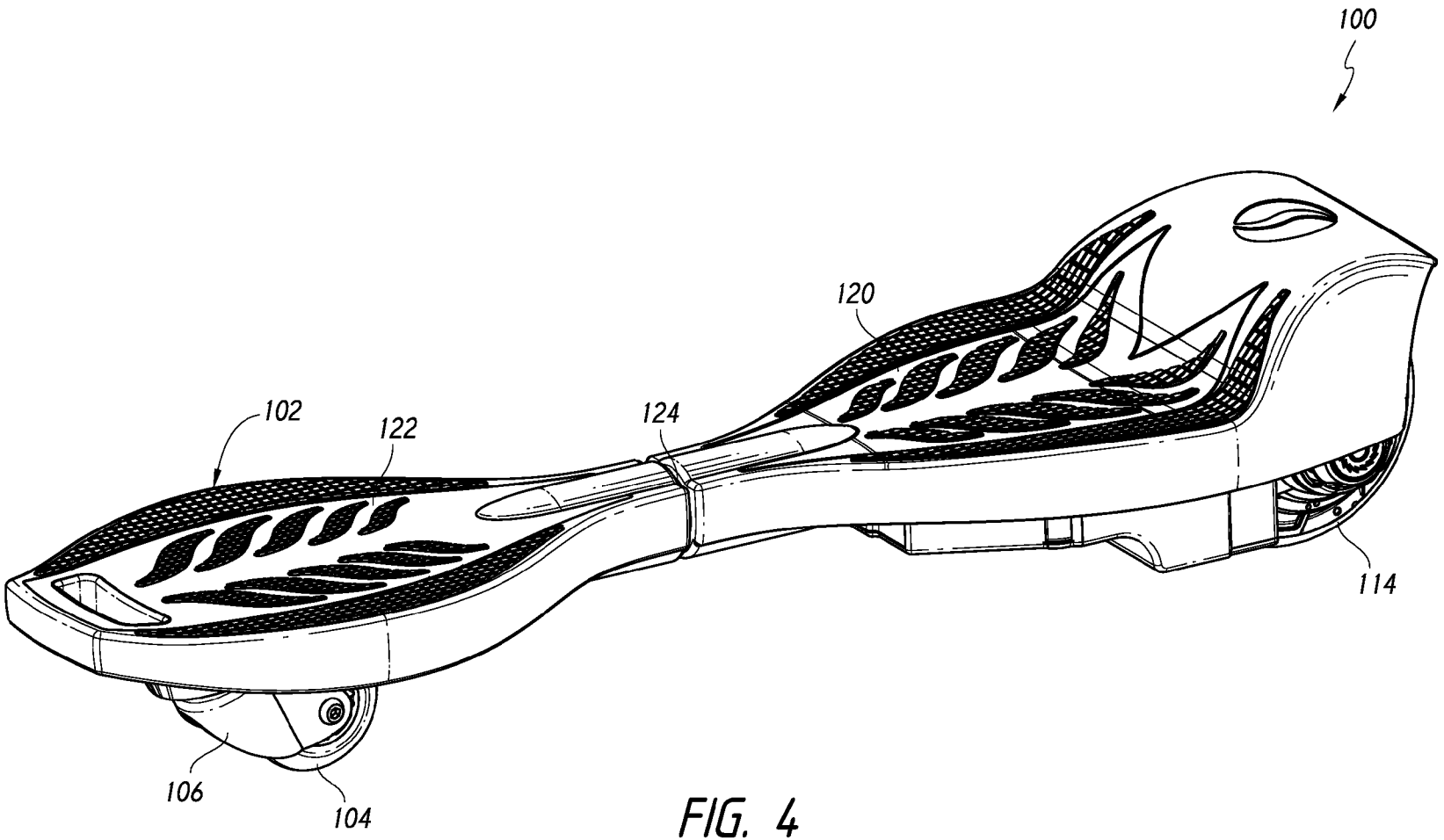
FIG. 4 is a top front perspective view of the skateboard of FIG. 1.
Figure 6:
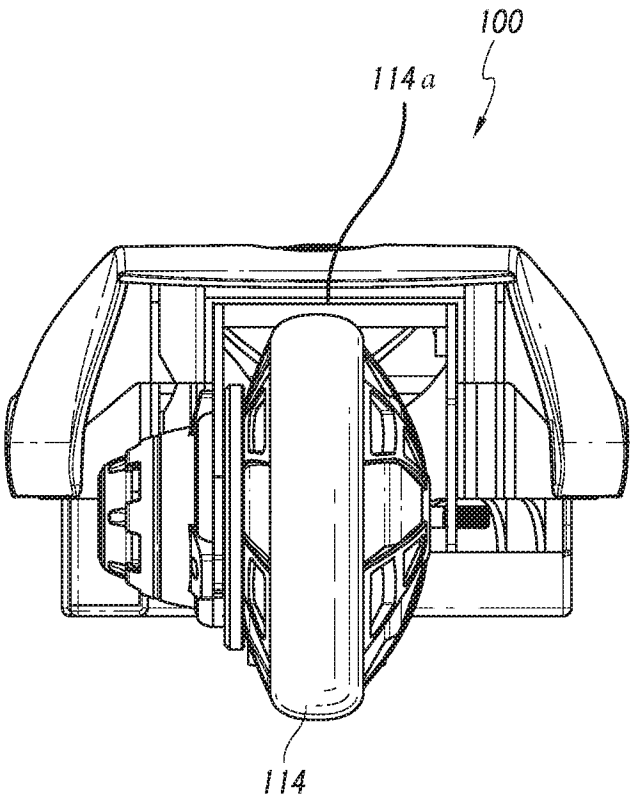
FIG. 6 is a rear view of the skateboard of FIG. 1.
Figure 5:
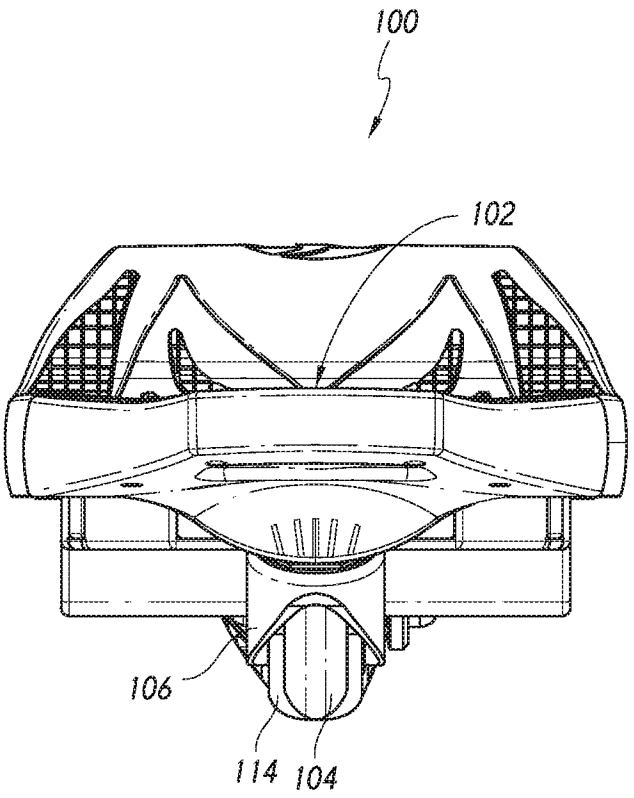
FIG. 5 is a front view of the skateboard of FIG. 1.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import. Throughout the following description, like numbers refer to like components.

Overview

Various embodiments of powered wheeled board vehicles are disclosed. As described in more detail below, the vehicles can include one or more powered rear wheels and one or more swivelable (e.g., caster) front wheels. Conventionally, this combination would be thought to render the vehicle inherently unstable, difficult to ride, and/or hard to control. This combination was typically thought to be particularly problematic when used on vehicles (e.g., skateboards) configured to permit twisting or flexing of the deck.

Furthermore, the addition of a powered rear wheel would typically be thought to negate the need for a swivelable front wheel. Some vehicles include swivelable front and rear wheels, as well as a deck that is configured to twist or flex, which can allow the user to create a locomotive force. But, with the addition of the powered rear wheel to provide the locomotive force, the swivelable front wheel would typically be thought to be unneeded. Accordingly, the swivelable front wheel would normally be replaced with a fixed (e.g., non-swivelable) wheel, such as to reduce cost, increase stability, etc.

Additionally, it was conventionally thought that positioning a powered wheel in the front of certain vehicles was preferred to placing the powered wheel in the rear of the vehicle. For example, having the powered wheel in the rear of the vehicle could be thought to reduce controllability compared to having the powered wheel in the front.

Nevertheless, certain embodiments described herein have shown that a vehicle can successfully include a powered rear wheel and one or more swivelable front wheels. In spite of the aforementioned and other concerns, such a vehicle can be sufficiently controllable and stable to provide an enjoyable riding experience.

Certain Vehicles with One Front Wheel

FIGS. 1-6 illustrate a powered wheeled board vehicle 100 having a deck 102 connected with a pair of wheels 104, 114. In the illustrated arrangement, the rear wheel 114 is powered, such as by an electric motor, and the front wheel 104 is swivelably connected with a caster assembly 106. The caster assembly 106 allows the front wheel to 104 to swivel about a first axis and rotate about a second axis (e.g., generally orthogonal to the first axis). Preferably, the rear wheel 114 is fixed in orientation relative to the deck 102. In the illustrated arrangement, the vehicle 100 includes inline wheels. That is, the front wheel 104 and the rear wheel 114 are aligned with a longitudinal axis of the vehicle 100 (when the front wheel 104 is in a straight or neutral position). In some configurations, such as those shown in FIGS. 1-6, the front wheel and the rear wheel can have different diameters, such as the rear wheel having a diameter that is at least twice the diameter of the front wheel. In other configurations, the front and rear wheels may be substantially the same or the same diameter.

In the illustrated embodiment, the rear wheel is powered by a hub motor arrangement (e.g., a motor integrated with the wheel 114). The hub motor arrangement or drive wheel arrangement includes a body or housing, which at least partially encloses a motor and transmission assembly. Preferably, a tire or other traction element that contacts a surface upon which the associated vehicle is ridden is adjacent to or is directly carried by the housing. That is, preferably, a diameter of the traction element is similar to but preferably slightly larger than a diameter of the housing and no substantial structural elements (e.g., spokes and rim) are provided between the housing and the traction element. Thus, the hub motor arrangement is well-suited for small diameter wheel applications, such as ride-on vehicles for children, such as the skateboards illustrated in the embodiments discussed herein, Preferably, the motor is a standard, commercially-available small DC brush motor. The transmission assembly is configured to convert the speed and torque of the motor into a speed and torque suitable for the drive wheel (housing and traction element or wheel). In addition, the motor and transmission assembly are configured for accommodation in the housing that is suitably sized and shaped for use as a drive wheel for a small vehicle. In part, this is accomplished by positioning the motor preferably along a center axis of the hub motor arrangement and offset axially or laterally to one side of a central plane of the hub motor arrangement or of the traction element. However, in some configurations, the motor could be off-center and/or spaced from the center axis of the hub motor arrangement. Preferably, the motor is surrounded by one or both of a support bearing for the housing and a mount 114*a* of the hub motor arrangement. In some arrangements, a portion of the motor is laterally or axially inboard of the support bearing and/or mount 114*a* that is nearest the motor (if multiple bearings/mounts are provided) and a portion of the motor is laterally or axially outboard of the support bearing and/or mount 114*a*. Advantageously, with such an arrangement, a standard motor can be used along with a transmission assembly suitable to convert the power of the motor into suitable drive power for the drive wheel arrangement to provide a relatively low-cost drive system for small or child vehicle applications. In addition, such an arrangement preserves space for the transmission of the hub motor arrangement.

In some embodiments, the hub motor arrangement is not a through-shaft type of arrangement in which an axle member or arrangement passes completely through the center of the hub motor, but is a distributed axle arrangement that provides suitable support while permitting the motor to be centrally-located or aligned with a central, rotational axis of the hub motor arrangement and to occupy a portion of the axis of rotation. That is, the motor is not a hollow design that surrounds the axis of rotation. Such an arrangement provides a well-balanced hub motor arrangement while permitting the use of a standard, commercially-available "off-the-shelf" motor to keep costs low. Although through-shaft type axle designs can also permit a motor to be aligned with a central, rotational axis of a motor, such an arrangement would require a custom motor design or at least a large motor design because the axle needs to be sufficient to support a substantial portion of the weight of the associated vehicle. In the illustrated arrangement, the shaft of the motor preferably does not support any significant weight of the associated vehicle. Additional details and features related to hub motors can be found in U.S. Patent Application Publication No. 2015/0133253, filed on Jun. 27, 2014, and U.S. Patent Application Publication No. 2015/0239527, filed on May 12, 2015, each of which are hereby incorporated by reference in their entirety.

In some embodiments, the motor is separate from the rear wheel 114. In such arrangements, the motor and the rear wheel 114 can be coupled by a suitable drive arrangement, such as a chain drive, belt drive or gear drive, among other possibilities. A source of power, such as a battery, can be provided at a suitable location, such as below the deck 102 or integrated with the deck 102.

The motor can be controlled by a wired or wireless remote control 110. The remote control 110 can include a transmitter and a trigger or other suitable control(s). Movement of the trigger and/or the amount of movement of the trigger can be detected, such as by a sensor in the remote control 110. This information can be used (e.g., by a processor or in the remote control 110 or on the skateboard 100) to determine an amount of motive power to be provided by the motor. In some embodiments, the transmitter can transmit a signal corresponding to the amount of trigger movement and a receiver on the skateboard 100 can receive the signal, which can be used to control the motor. As illustrated, in some embodiments, the trigger comprises an accelerator to control motive power provided by the motor. Although a "pistol-grip" style of remote control 110 is shown, other configurations are contemplated as well, such as a button, switch, joystick, toggle, slider, trackball, smartphone app, or otherwise. In some configurations, the remote control 110 is the only element of the vehicle 100 that is controlled with a hand. For example, in some implementations, although the throttle is controlled via remote control 110, the user controls all other aspects of the vehicle 100 with his or her feet in a manner similar to a normal or caster skateboard. In at least some configurations, the vehicle 100 does not include a handlebar or other hand support that is connected to the deck 102 or other portion of the vehicle 100.

In contrast to certain powered vehicles with controls on handlebars or other supports, the remote control 110 can allow a user to move both of his or her hands during operation of the vehicle, while still being able to control locomotion of the vehicle. In some embodiments, the remote control 110 is configured to be held and operated by a single hand. In some embodiments, remote control 110 can facilitate user safety, such as by not restraining the user's hands to handlebars or other supports, and instead readily allowing the user to move his or her hands to catch the user in the case of a fall.

In some configurations, the vehicle 100 can include a brake, which can be controlled by the remote control 110. In some embodiments, the braking functionality is provided by the motor. In some variants, the brake comprises a drum brake, disk brake, caliper brake, or otherwise.

The deck 102 can be of any suitable size, shape or arrangement. As illustrated in FIGS. 1-6, the deck 102 includes a first or forward portion 122 that connects with the front wheel 104 and a second or rearward portion 120 that connects with the rear wheel 114. In some embodiments, such as in the embodiment shown, the forward portion 122 and the rearward portion 120 are coupled, such as by a rotational coupling 124. This can permit rotational movement of the forward portion 122 relative to the rearward portion 120, such as along the longitudinal axis of the vehicle 100. The rotational coupling 124 can include one or more pivot assemblies and/or a biasing element to bias the forward portion 122 and the rearward portion 120 into a neutral or aligned relative position. For example, the deck 102 can be configured as shown, substantially as shown or similarly to the arrangements disclosed in U.S. Pat. Nos. 7,195,259 and 7,775,534, the entireties of which are hereby incorporated by reference herein. In some embodiments, the forward and rearward portions 120, 122 are coupled by a flexible neck.

Figure 7:
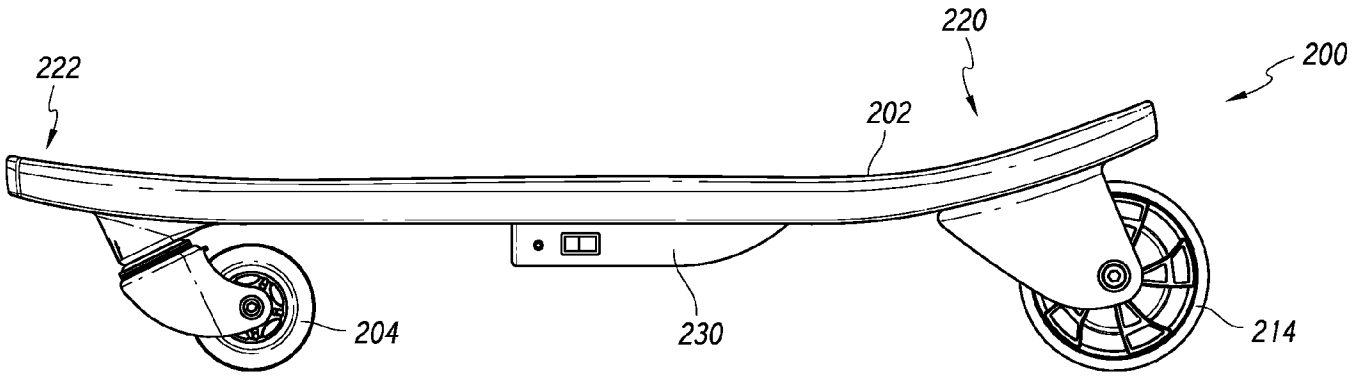
FIG. 7 is a side view of a skateboard according to another embodiment.
Figure 8:
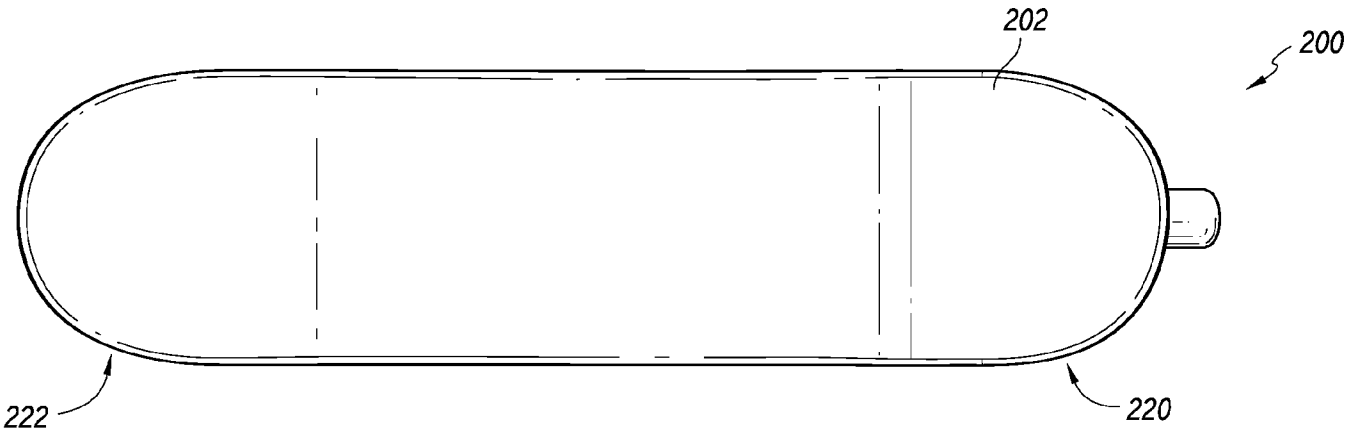
FIG. 8 is a top view of the skateboard of FIG. 7.

In some configurations, as illustrated in FIGS. 7 and 8, the vehicle 200 can include a deck 202 that is relatively consistent in lateral width throughout its length or at least within a mid-portion of its length (generally between a forward portion 222 and a rearward portion 220 of the deck 202). In some implementations, at least a majority of the length of the lateral sides of the deck 202 is substantially parallel with the longitudinal axis of the vehicle 200. A source of power, such as a battery 230, can be provided at a suitable location, such as below the deck 202 or integrated with the deck 202. If a hub motor is provided, it can be the same as, substantially the same as or similar to the hub motors discussed above and disclosed in U.S. Patent Application Publication No. 2015/0133253, filed Jun. 27, 2014, and/or U.S. Patent Application Publication No. 2015/0239527, filed May 12, 2015, which are each hereby incorporated by reference in their entirety. As shown, in certain embodiments, the rearward portion 220 comprises an angled tail, such as an angled tail at least about 10° from the longitudinal axis of the deck 202. In certain implementations, the rear wheel 214 and/or the motor connect with the angled tail of the rearward portion 220.

Figure 9:
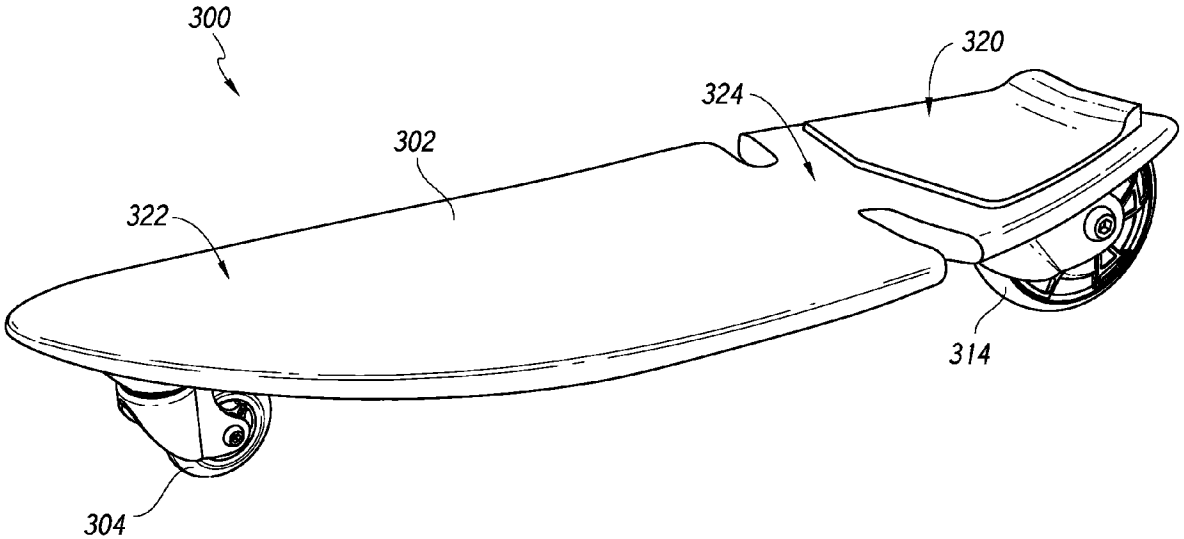
FIG. 9 is a top front perspective view of a skateboard according to another embodiment.
Figure 10:
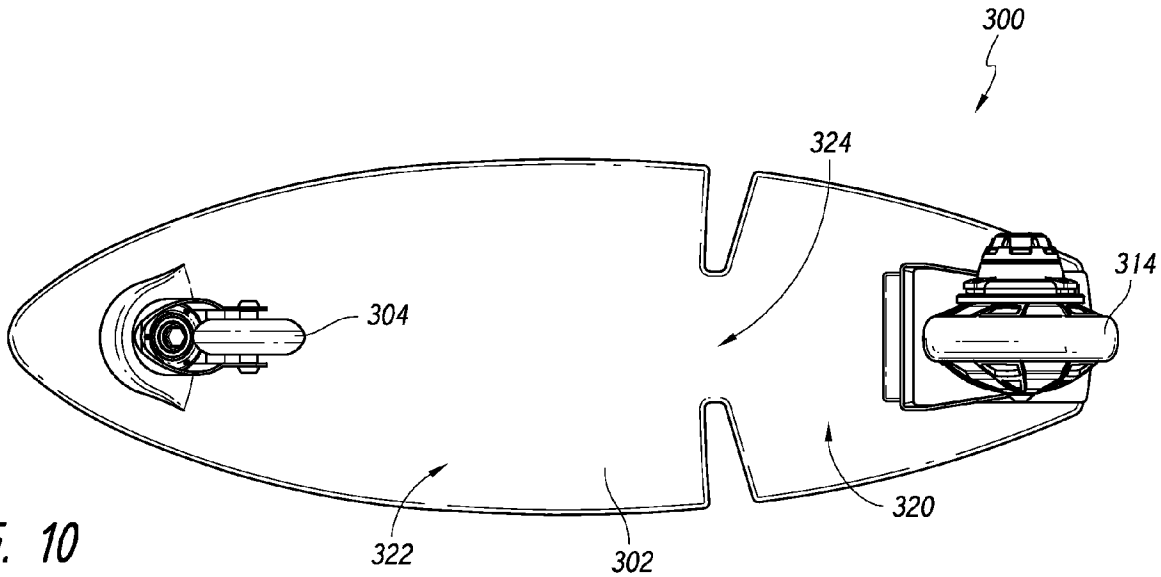
FIG. 10 is a bottom view of the skateboard of FIG. 9.

Another configuration of a powered wheeled vehicle 300 is shown in FIGS. 9 and 10. In this configuration, the powered wheeled board vehicle 300 has a deck 302 with a triangular or arrowhead-like shape that resembles the shape of a surfboard or boogie board. The deck 302 has a forward portion 322 and a rearward portion 320. The forward portion 322 narrows to a point such that the sides of the deck 322 converge to a point at a forward end of the deck 302. As shown, in certain embodiments, the rearward portion 320 comprises an angled tail, such as an upwardly angled tail at least about 10° from the longitudinal axis of the deck 302. In certain implementations, the rear wheel 314 and/or the motor connect with the angled tail of the rearward portion 320.

As further illustrated in FIGS. 9 and 10, in some embodiments, the forward portion 322 and the rearward portion 320 are rigidly coupled, such as through a neck that is laterally narrower than the portions 320, 322. For example, the deck 302 can have a neck portion 324 between the forward portion 322 and the rearward portion 320. In various embodiments, the neck portion 324 is thinner in the lateral direction than the forward portion 322 and the rearward portion 320. For example, ratio of the maximum lateral width of the forward portion 322 to the maximum lateral width of the neck portion 324 can be at least: 1.5:1, 2:1, 3:1, 4:1, or other ratios. Some examples of configurations comprising neck portions are shown in FIGS. 9, 10, 15, and 16, as well as in U.S. Pat. Nos. 7,338,056, 7,600,768 and 7,766,351 (which are hereby incorporated by reference herein in their entirety). In some configurations, a lateral axis bisects the deck at a midpoint of the deck and the lateral axis is orthogonal to a longitudinal axis of the deck. In some configurations, the forward portion 322 narrows to a point forward of the lateral axis and a thin or neck portion 324 is rearward of the lateral axis.

The neck portion 324 can be configured to allow the deck 302 to flex or twist. In various embodiments, the deck 302 can flex or twist in response to pressure from the user's feet, such as due to the user's weight shifting laterally on the deck 302. This can result in forward portion twisting or rotating relative to the rearward portion in alternating directions about a longitudinal axis of the deck. The flex or twist of the deck 302 can be used to steer, control, and/or propel the vehicle 300. Further description of this feature can be found in U.S. Pat. Nos. 7,338,056, 7,600,768 and 7,766,351.

Certain Vehicles with Multiple Front Wheels

In some configurations, as illustrated in FIGS. 11, 12, and 14-16, the vehicle 400 can include a deck 402 that connects with multiple front wheels 404, such as two, three, or more. Preferably, the front wheels are caster wheels. Preferably, the deck 402 also connects with a rear powered wheel 414. In some embodiments, the deck can connect with more than one rear powered wheel, such as two, three, or more. As illustrated, there can be two or more front caster wheels 404 arranged side-by-side such that an axis passing through the center of each of the front wheels is orthogonal to a longitudinal axis of the vehicle 400 when the two front wheels 400 are in a neutral orientation or aligned parallel to the longitudinal axis of the vehicle 400 or in other arrangements.

Figure 11:
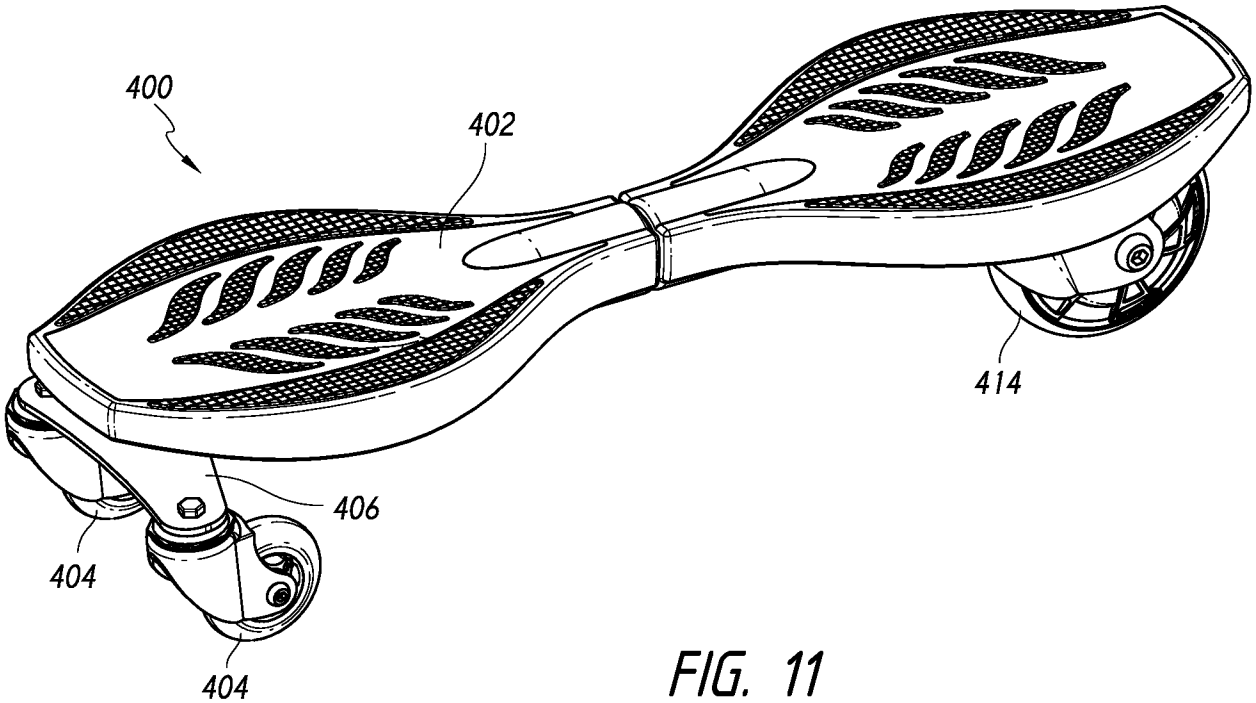
FIG. 11 is a top front perspective view of a skateboard according to another embodiment.
Figure 13:
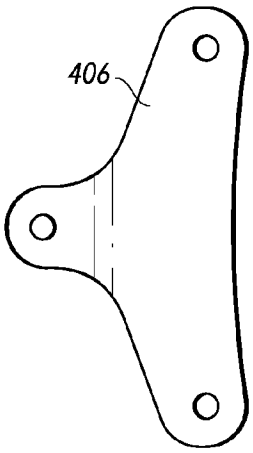
FIG. 13 is a top view of a caster wheel attachment member.
Figure 12:
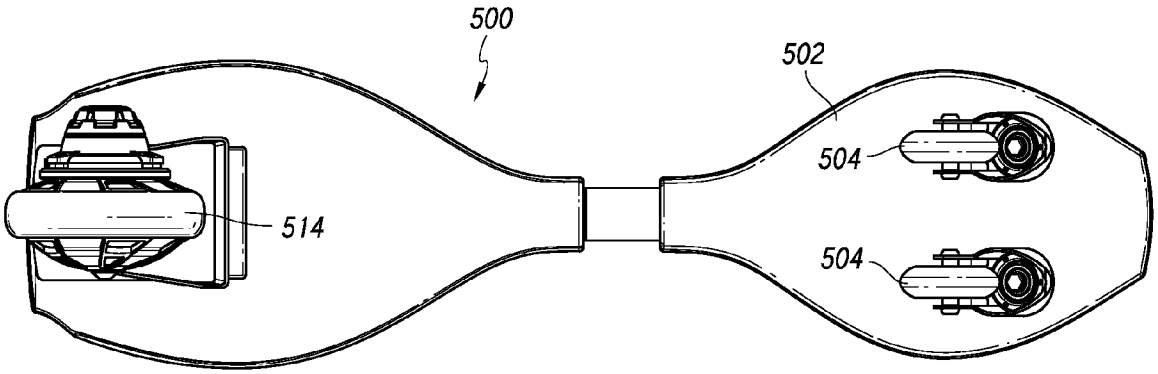
FIG. 12 is a bottom view of a skateboard according to another embodiment.
Figure 15:
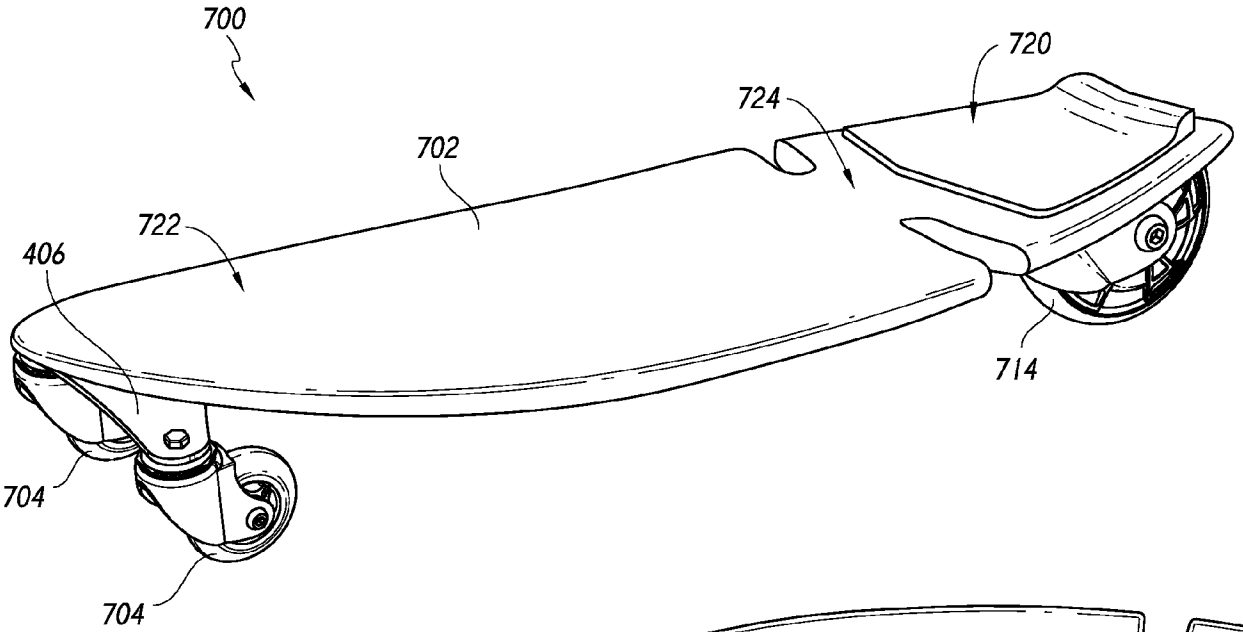
FIG. 15 is a top front perspective view of a skateboard according to another embodiment.
Figure 16:
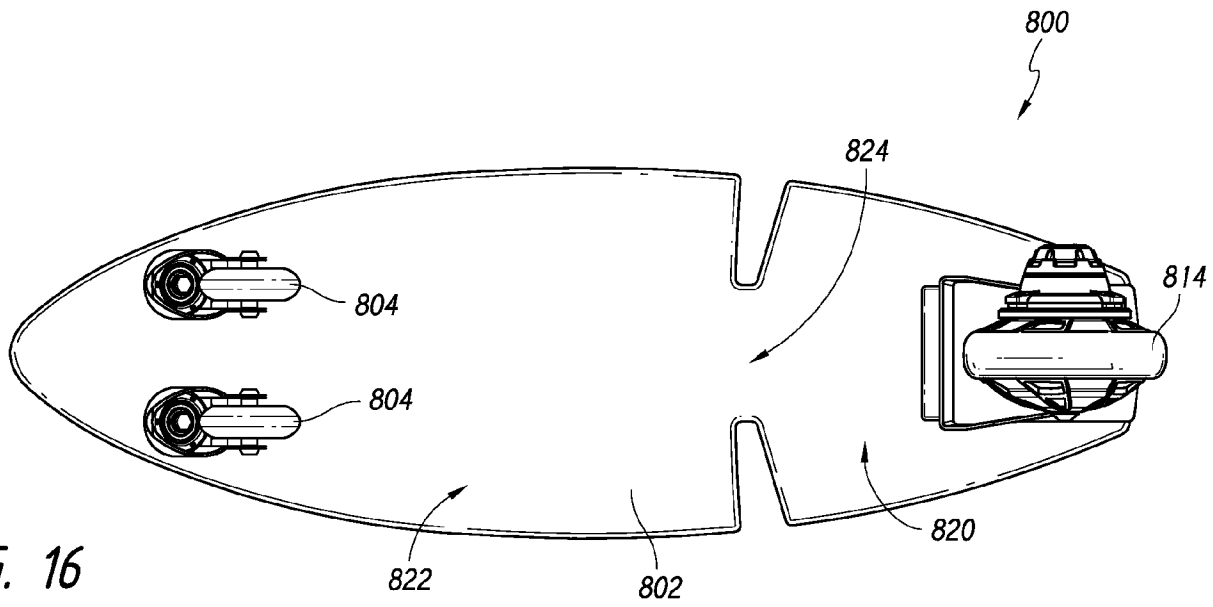
FIG. 16 is a bottom view of a skateboard according to another embodiment.

In some embodiments, as shown in FIG. 11, the front caster wheels 404 are connected with a mounting bracket 406, which in turn is connected with the deck 402 of the vehicle 400. The mounting bracket 406 can be configured to move relative to the deck 402. For example, in some embodiments, the mounting bracket 406 can pivot and/or rock relative to the deck 402. Examples of embodiments of mounting brackets 406 are shown in FIGS. 11, 13, and 15. In some configurations, the deck can directly connect with multiple front wheels (that is, without a mounting bracket). Examples of such direct connection configurations are shown in FIGS. 12, 14, and 16.

Figure 14:
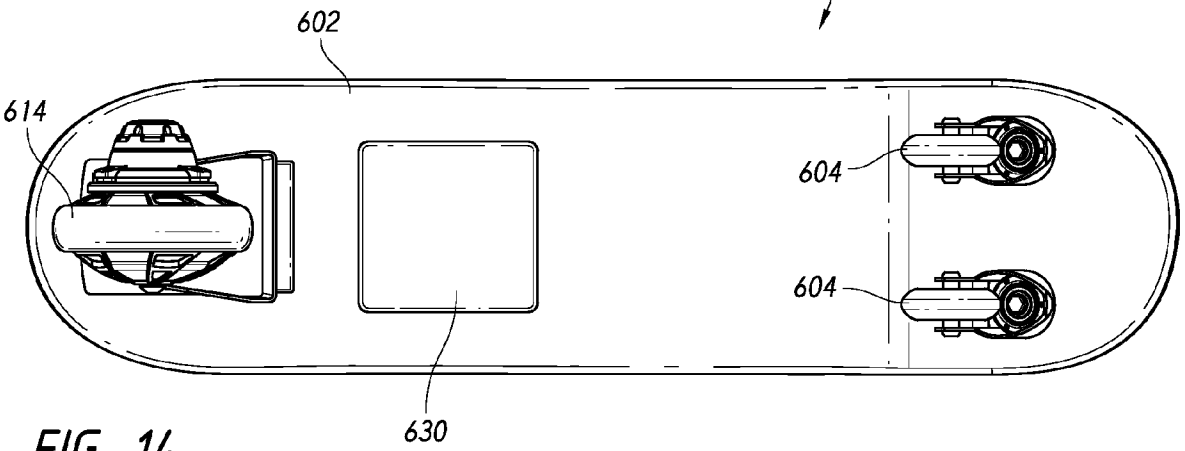
FIG. 14 is a bottom view of a skateboard according to another embodiment.

In some configurations, as illustrated in FIGS. 7 and 14, the deck 402 can also support a battery pack 430, as discussed above. The battery pack 430 may be mounted on an underside of the deck 402 between the front wheels and the rear wheel. In some configurations, the battery pack 430 may be mounted on an underside of the front portion or on an underside of the rear portion.

In addition to the embodiments shown in FIGS. 11, 12, and 14-16, the other embodiments disclosed in this application can also be configured to include two or more front wheels which can change the riding characteristics of the vehicle.

Operation of the Vehicle

In operation, the user places his or her feet generally on the front portion and rear portion of the deck 102. The user may rotate his or her body, shift his or her weight, and/or modify his is or her foot positions to control the motion of the vehicle 100. For example, for steering, one side of the deck 102 can be tilted towards the ground to encourage a turn in that direction. In some configurations, the vehicle 100 may be operated as a flexible skateboard in that the user may cause, maintain, or increase locomotion of the vehicle 100 by causing the front and rear portions to be twisted or rotated relative to each other generally about a longitudinal axis of the deck 102.

In various embodiments, the rear wheel 114 can be used to accelerate or decelerate the vehicle. For example, the remote control 110 can be used to send a signal to control (e.g., increase or decrease) an amount of power provided to the rear wheel by the motor and/or to initiate a braking action. The user can still control steering of the vehicle 100 by rotating his or her body, or by shifting his or her weight and/or foot position, on the deck 102 as discussed above.

In contrast to a conventional skateboard, movement of the vehicle 100 can be provided without the user needing to move his or her feet. For example, from a stopped position, the user can place his or her feet on the deck 102 and can actuate the trigger on the remote, thereby causing the motor to drive the rear wheel, which in turn propels the vehicle. In some embodiments, the user does not need to lift a foot off the deck and push off the ground in order to provide locomotion. In certain variants, the user does not need to move his or her feet (e.g., to cause the forward and rearward portions to move relative to one another) in order to provide locomotion.

CONCLUSION

Many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described.

A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes, or tends toward, a particular value, amount, or characteristic. For example, as the context may dictate, the term "generally parallel" can mean something that departs from exactly parallel by less than or equal to 15°.

Some embodiments have been described in connection with the accompanying drawings. The figures are drawn to scale, but such scale should not be interpreted to be limiting. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Also, any methods described herein may be practiced using any device suitable for performing the recited steps.

In summary, various illustrative embodiments and examples of powered wheeled boards have been disclosed. Although the powered wheeled boards have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow as well as their full scope of equivalents.

What is claimed is:

1. A powered board vehicle, comprising:

a flexible deck having a forward portion and a rearward portion;

at least one front wheel connected with the deck under the forward portion, the front wheel configured to swivel about a first axis and rotate about a second axis; and a powered rear wheel connected with the deck and in a fixed alignment relative to the deck, wherein the powered rear wheel comprises a hub motor configured to drive the powered rear wheel from a position laterally offset along an axis of rotation of the powered rear wheel such that the hub motor is disposed outside of the powered rear wheel and a longitudinal axis of the hub motor is generally collinear with the axis of rotation, wherein the powered rear wheel further comprises a central plane disposed along a longitudinal axis of the vehicle, and wherein the hub motor is laterally offset from the central plane;

wherein the deck permits rotation of the forward portion relative to the rearward portion to permit a user to twist the forward portion relative to the rearward portion in alternating directions about a longitudinal axis of the deck.

2. The vehicle of claim 1, wherein the front wheel and the rear wheel are aligned with the longitudinal axis of the vehicle.

3. The vehicle of claim 1, wherein a diameter of the front wheel is different from a diameter of the rear wheel.

4. The vehicle of claim 1, wherein a diameter of the front wheel is equal to a diameter of the rear wheel.

5. The vehicle of claim 1, wherein the vehicle further comprises two front, swivelable wheels connected with the deck under the forward portion, the two front wheels aligned such that an axis passing through a center of each of the front wheels is orthogonal to the longitudinal axis of the vehicle when the two front wheels are aligned parallel to the longitudinal axis of the vehicle.

6. The vehicle of claim 5, wherein the two front wheels are supported by a mounting bracket that is supported by the deck, wherein the mounting bracket is configured to move relative to the deck.

7. The vehicle of claim 6, wherein the mounting bracket can pivot or rock relative to the deck.

8. The vehicle of claim 1, further comprising a rotational coupling or other torsional-flex-facilitating structure between the forward portion and the rearward portion of the deck.

9. The vehicle of claim 8, wherein the rotational coupling includes one or more pivot assemblies and a biasing element to bias the forward portion and the rearward portion into a neutral or aligned relative position.

10. The vehicle of claim 1, wherein the deck further comprises a molded plastic platform to provide a gripping surface on a top surface of the deck.

11. The vehicle of claim 1, wherein the deck further comprises a thin portion in a lateral direction between the forward portion and the rearward portion to allow the deck to twist or flex.

12. The vehicle of claim 11, wherein a lateral axis bisects the deck at a midpoint of the deck, the lateral axis orthogonal to the longitudinal axis of the deck, the forward portion of the deck narrows to a point forward of the lateral axis and the thin portion is rearward of the lateral axis.

13. The vehicle of claim 1, wherein the deck is relatively consistent in lateral width throughout at least a midpoint of a length of the deck and wherein a source of power is supported by the deck.

14. The vehicle of claim 1, further comprising a wired or wireless remote control that controls the powered rear wheel.

15. The vehicle of claim 1, wherein the hub motor further comprises a mount configured to support the hub motor, and wherein at least a portion of the hub motor is laterally offset inboard of the mount and at least a portion of the hub motor is laterally offset outboard of the mount.

16. A powered personal mobility vehicle, comprising:

a body having a deck, the deck being configured to support a user, the deck having a forward portion and a rearward portion;

a caster assembly connected with the deck;

at least one front wheel connected with the caster assembly and rotatable about a first axis;

a rear wheel connected with the body and rotatable about a second axis; and a hub motor connected with the body and arranged to transfer rotational force to the rear wheel from a position laterally offset along the second axis of the rear wheel such that the hub motor is disposed outside of the rear wheel;

wherein the forward and the rearward portions are spaced apart by a neck portion that is laterally narrower than both the forward portion and the rearward portion, thereby allowing the deck to twist or flex about a longitudinal axis of the vehicle that passes through the neck, wherein the rear wheel comprises a central plane disposed along a longitudinal axis of the powered personal mobility vehicle, and wherein the hub motor is laterally offset from the central plane.

17. The vehicle of claim 16, further comprising two front caster wheels connected to a mounting bracket connected to the body such that an axis passing through a center of each of the front wheels is orthogonal to a longitudinal axis of the body when the front caster wheels are oriented parallel to the longitudinal axis of the body.

18. The vehicle of claim 17, wherein the mounting bracket is configured to move relative to the deck.

19. The vehicle of claim 16, wherein the front wheel and the rear wheel are aligned with the longitudinal axis of the vehicle.

20. A vehicle assembly comprising:

the powered personal mobility vehicle claim 16; and a remote control configured to wirelessly communicate with a control unit on vehicle, the control unit comprising a processor and a receiver, the control unit configured to control the amount of power provided to the motor.

21. The vehicle of claim 16, wherein the hub motor further comprises a mount configured to support the hub motor, and wherein at least a portion of the hub motor is laterally offset inboard of the mount and at least a portion of the hub motor is laterally offset outboard of the mount.

22. A powered board vehicle, comprising:

a flexible deck having a forward portion and a rearward portion;

at least one front wheel connected with the deck under the forward portion, the front wheel configured to swivel about a first axis and rotate about a second axis; and a powered rear wheel connected with the deck and in a fixed alignment relative to the deck, the powered rear wheel comprising a hub motor configured to drive the powered rear wheel from a position laterally offset along an axis of rotation of the powered rear wheel such that the hub motor is disposed outside of the powered rear wheel and such that a longitudinal axis of the hub motor is generally collinear with the axis of rotation;

wherein the hub motor comprises a mount configured to support the hub motor, and wherein at least a portion of the hub motor is laterally offset inboard of the mount and at least a portion of the hub motor is laterally offset outboard of the mount; and wherein the deck permits rotation of the forward portion relative to the rearward portion to permit a user to twist the forward portion relative to the rearward portion in alternating directions about a longitudinal axis of the deck.

23. The vehicle of claim 22, wherein the vehicle further comprises two front, swivelable wheels connected with the deck under the forward portion, the two front wheels aligned such that an axis passing through a center of each of the front wheels is orthogonal to a longitudinal axis of the vehicle when the two front wheels are aligned parallel to the longitudinal axis of the vehicle.

24. The vehicle of claim 22, further comprising a rotational coupling or other torsional-flex-facilitating structure between the forward portion and the rearward portion of the deck.

25. The vehicle of claim 22, wherein the deck further comprises a thin portion in a lateral direction between the forward portion and the rearward portion to allow the deck to twist or flex.

* * * * *